United States Patent [19]

Lautenschläger

[11] 4,290,167

[45] Sep. 22, 1981

[54] HINGE FOR FURNITURE PIECES WITH A FRAME EXTENDING INTO THE DOOR OPENING

[75] Inventor: Horst Lautenschläger, Reinheim, Fed. Rep. of Germany

[73] Assignee: Mepla Inc., High Point, N.C.

[21] Appl. No.: 112,814

[22] Filed: Jan. 17, 1980

[51] Int. Cl.[3] ..... E05D 7/04

[52] U.S. Cl. ..... 16/129; 16/130; 16/131; 16/163; 248/668

[58] Field of Search ..... 16/129–135, 16/163, 164; 248/668, 188.2, 188.8

[56] References Cited

U.S. PATENT DOCUMENTS

| | | | |
|---|---|---|---|
| 2,779,559 | 1/1957 | Bertuch | 248/668 X |
| 3,030,730 | 4/1962 | Costar | 248/668 X |
| 3,772,735 | 11/1973 | Lautenschläger | 16/131 X |
| 3,909,879 | 10/1975 | Grünert et al. | 16/131 X |
| 4,091,499 | 5/1978 | Lautenschläger | 16/129 |
| 4,120,598 | 10/1978 | Zernig et al. | 16/129 X |
| 4,156,301 | 5/1979 | Schneider et al. | 16/131 |
| 4,207,652 | 6/1980 | Lautenschläger | 16/130 |

FOREIGN PATENT DOCUMENTS

| | | | |
|---|---|---|---|
| 1809616 | 7/1969 | Fed. Rep. of Germany | 16/130 |
| 2210614 | 9/1973 | Fed. Rep. of Germany | 16/163 |
| 2806958 | 8/1978 | Fed. Rep. of Germany | 16/129 |
| 2720096 | 11/1978 | Fed. Rep. of Germany | 16/129 |

*Primary Examiner*—James Kee Chi

[57] ABSTRACT

An articulated hinge for the pivotal connection of a door leaf to the carcass of a furniture piece from whose carcass wall a frame protrudes at right angles, which frame has an end face delimiting an unobstructed door opening. The hinge has a door-related mounting part pivotally connected via a link mechanism with a carcass-related mounting part which comprises a flange plate which holds the linkage mechanism and which is detachably connectable to the end face of the frame. Below the bottom side of the flange plate facing the frame end face there is an adjustment plate which is displaceable by a predetermined measure relative to the flange plate in the longitudinal direction of the frame end face. The surfaces of the flange plate and the adjustment plate which face each other are provided with at least one complementary inclined ramp surface each, which upon displacement of the adjustment plate relative to the flange plate slide on each other up and down, respectively, and effect a change in the distance of the flange plate from the end face of the frame and thereby a corresponding change of the measure of the overlap of the frame by the engaged door leaf.

11 Claims, 9 Drawing Figures

FIG. 1
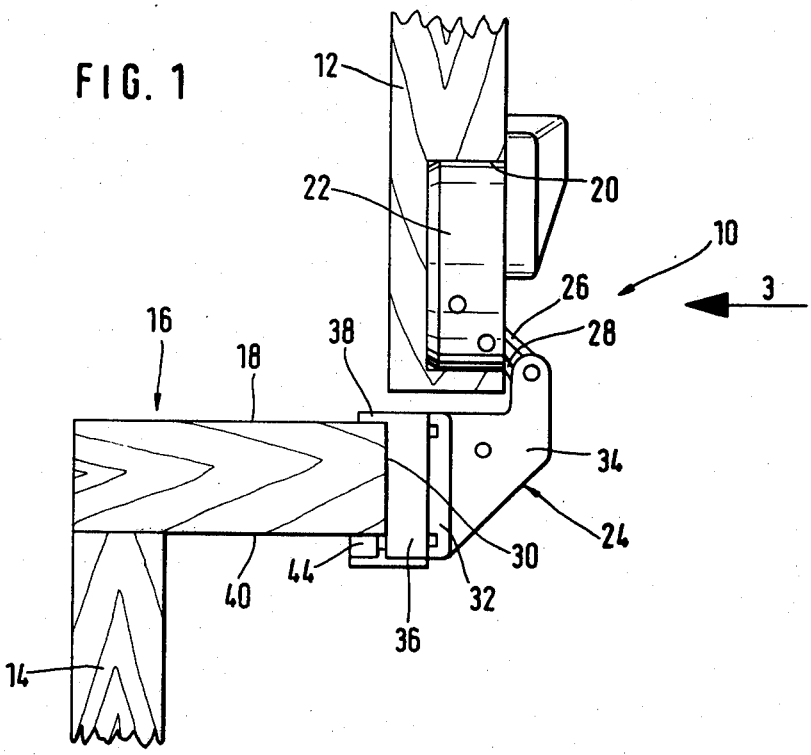
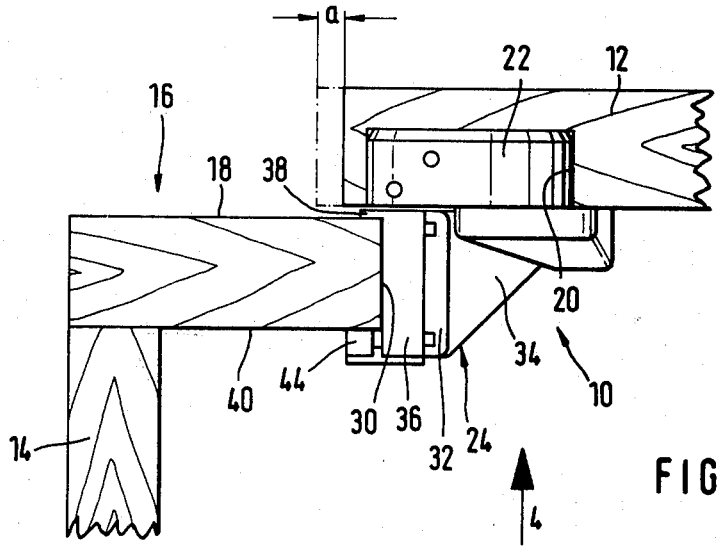
FIG. 2

FIG. 3
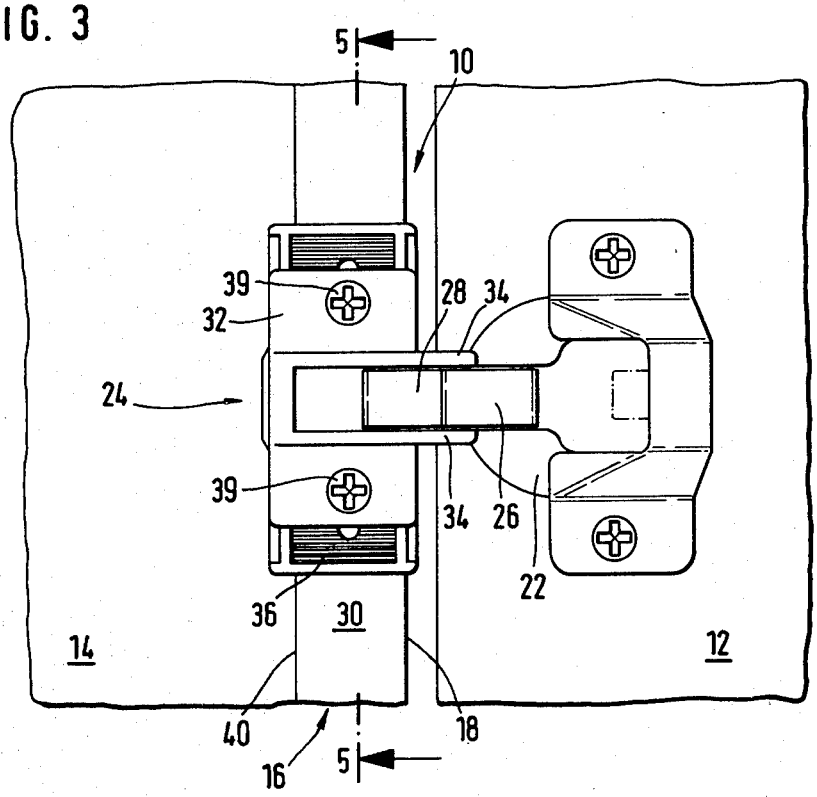
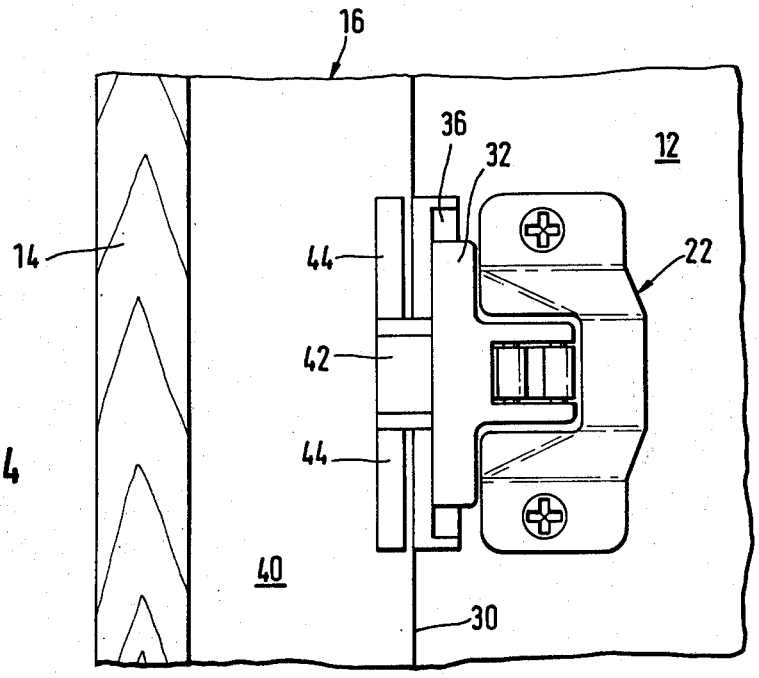
FIG. 4

HINGE FOR FURNITURE PIECES WITH A FRAME EXTENDING INTO THE DOOR OPENING

BACKGROUND OF THE INVENTION

The invention relates to an articulated hinge for the mounting of a door leaf or flap at the carcass of a furniture piece from whose carcass walls at right angles a frame protrudes which narrows the clear or unobstructed door opening of the furniture piece. The frame is partially covered in the closed position of the door by the engaged door leaf. The hinge comprises a carcass-related part adapted to be adjustably connected to the frame and a door-related part adapted to be connected to the door leaf and pivotally connected with the carcass-related part by means of a link mechanism.

With the customary articulated hinges which, for instance, may have the form of four-joint hinges or cross-link hinges, the carcass-related mounting part which as a rule is designed as an elongated supporting arm is customarily mounted on an elongated mounting plate, the supporting arm being fitted over the mounting plate and being adapted to be fixed adjustably in different directions of a system of coordinates. The mounting plate is ordinarily connected to the inner surface of a side wall of the piece of furniture or to a supporting wall. This, however, is not possible with furniture cabinets of the type in question here which have on the door side a frame extending all around the door opening and confining the same and which also protrudes at right angles from the furniture carcass. Such cabinets, however, are for sale in considerable volume, especially as kitchen cabinets, and were up to now equipped with well known conventional single-joint hinges for the attachment of the doors, the joint of these hinges being externally visible in front of the frame adjacent the door. Since it is desirable also with such cabinets to connect the door with a hinge which is invisible when the doors are closed, a mounting element was developed to which the support arm of the customary, articulated hinges can be connected. Such a mounting element is described in U.S. patent application Ser. No. 928,776, filed July 28, 1978, now U.S. Pat. No. 4,207,652. However, this mounting element requires a milled opening extending from the front to the back side of the frame, which on the one hand requires special work steps for producing such a milled opening, and on the other hand weakens the frame.

It is, therefore, an object of the present invention to provide a hinge which can be connected to the frame of a furniture piece, which frame extends into the door opening, and which hinge can be connected directly to the frame without requiring a milled opening in the frame, while at the same time providing for an adjustment of the hinge with respect to the amount by which the door leaf covers the front face of the frame in the closed position of the door leaf.

Starting with a hinge of the above-mentioned type, the problem underlying the present invention has been solved by providing the carcass-related mounting plate with a flange plate which holds the link mechanism and which can be removably connected to the end face of the frame which is set inwardly relative to the supporting wall and which confines the clear or unobstructed door opening. Moreover, underneath the bottom side of the flange plate facing the end face of the frame there is arranged an adjustment plate which is displaceable relative to the flange plate in the longitudinal direction of the end face of the frame by a predetermined amount. Still furthermore, the invention is characterized in that at those surfaces of the flange plate and the adjustment plate which face each other there is provided, respectively, at least one complementary inclined ramp surface which upon displacement of the adjustment plate relative to the flange plate slide up and down relative to each other and effect a change in the distance at the flange plate from the end face of the frame and thereby a corresponding change in the amount of the overlap or cover of the front side of the frame by the engaged door leaf. The flange plate of the thus constructed hinge, therefore, can be connected directly to the end face of the frame while the adjustment of the overlap of the door, i.e., the alignment of the door leaf relative to the clear or unobstructed door opening of the piece of furniture is possible by a corresponding alignment of the flange plate and the adjustment plate relative to each other.

By providing ribs and recesses, respectively, which extend in the direction of the displacement of the adjustment plate and which engage each other, the flange plate and the adjustment plate can be prevented from movement in directions deviating from the intended direction of the displacement of the adjustment plate.

The adjustment plate is preferably somewhat wider than the thickness of the frame, as measured between the front and rear side of the frame, while a thin abutment strip or ledge is provided on the longitudinal margin associated with the front side of the frame and extends from the bottom of the plate somewhat and can engage the front side of the frame. For the correct mounting of the hinge on the end face of the frame, such that the door leaf to be mounted engages the frame with the smallest possible gap, it is then merely necessary to effect the mounting such that the abutment ledge engages the front side of the frame in the final mounted position of the hinge.

This engagement of the abutment ledge at the front side of the frame can be guaranteed additionally by providing the adjustment plate at its longitudinal margin associated with the back side of the frame with at least one resilient element extending from its bottom side and adapted to be pretensioned transverse to the adjustment plate. This resilient element rests in the appropriate arrangement of the hinge on the frame under pretension against the back side of the frame and thereby holds the abutment ledge against the front face of the frame.

The resilient element is suitably formed by at least one tongue resiliently arranged at an extension of the adjustment plate.

For purposes of connecting the hinge to the end face of the frame the flange plate is advantageously penetrated by at least one, preferably two bores for connecting screws which can be screwed into the end face of the frame. The adjustment plate is then in the area below the bore or bores, respectively, provided with an oblong hole extending in the direction of displacement. Thus, the flange plate is fixedly, non-displaceably held relative to the frame by the connecting screws whereas the adjustment plate, with the connecting screws loosened, is displaceable longitudinally by an amount determined by the length of the oblong hole.

In order to prevent an unintentional variation in the adjusted overlap of the door leaf, the complementary ramp surfaces facing each other, i.e., the ramp surfaces of the flange plate and the adjustment plate, in a further development of the present invention are provided with a plurality of transverse ribs extending transverse to the direction of displacement of the adjustment plate and with uniform spacing. Upon tightening of the connecting screws the ribs on the ramp surface of one part of the hinge are forced into the intermediate spaces between the ribs of the other hinge part and this achieve a positive, form-locking connection which prevents displacement.

In order to hold the linkage mechanism to the carcass, the flange plate is advantageously provided with suitably bearing extensions while the flange plate including the bearing extensions is preferably made as an integral die-cast part of metal, especially zinc die-cast part (Zamak).

The adjustment plate is preferably made as an injection molded plastic part although its manufacture from metal is entirely within the scope of the invention.

Depending on the required opening angle of the hinge, the same is provided with a suitable linkage mechanism. If a hinge or door opening angle of from 90 to a maximum of 110 degrees is required, a four-joint linkage mechanism is selected which is formed by two hinge links with their ends pivotally journaled on one hand at the carcass-related mounting part and on the other hand at the door-related mounting part.

If, however, a larger door opening angle of up 180 degrees is required, the carcass-related mounting part is connected with the door-related mounting part by a cross-link mechanism suitable for such an opening angle.

BRIEF DESCRIPTION OF THE DRAWINGS

Two embodiments of the invention are shown in the accompanying drawings, in which:

FIGS. 1 and 2 show, in side view, a first embodiment of the invention in the form of a four-joint hinge the carcass-related mounting part of which is connected to the face of a frame extending from the side wall of the cabinet and the door-related mounting part of which is fixed in a recess of a door leaf; FIG. 1 showing the open and FIG. 2 the closed position;

FIG. 3 is a front view as seen in the direction of the arrow 3 in FIG. 1;

FIG. 4 is a front view as seen in the direction of the arrow 4 in FIG. 2;

DETAILED DESCRIPTION OF PREFERRED EMBODIMENTS

Figure 5:
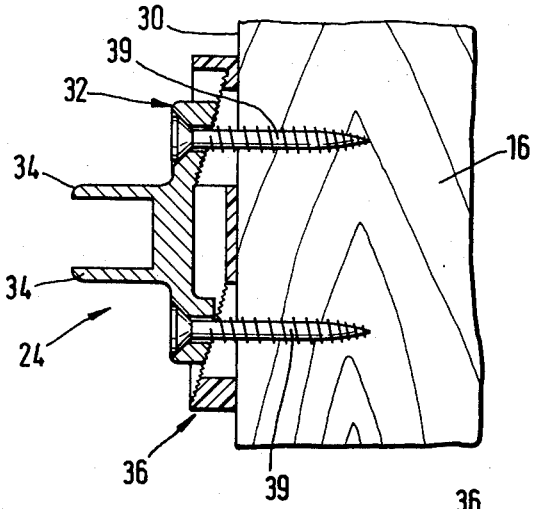
FIG. 5 is a section as seen in the direction of the arrows 5—5 in FIG. 3.
Figure 6:
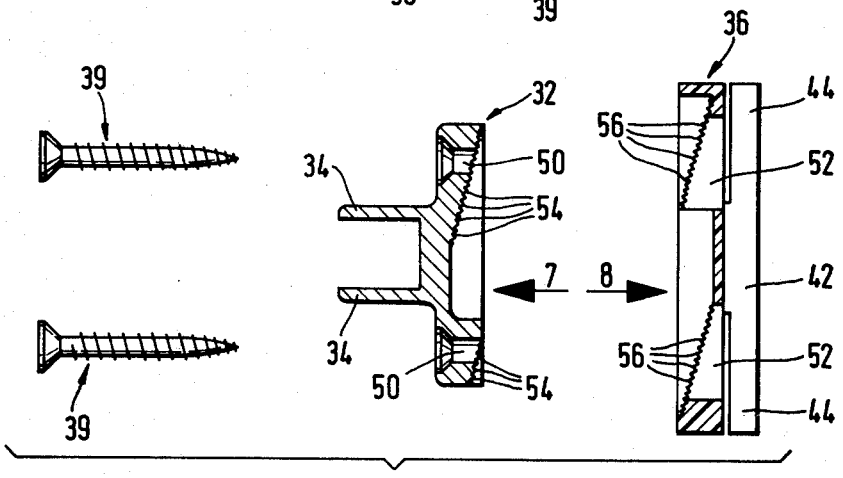
FIG. 6 represents the part of the hinge shown in FIG. 5 but shown prior to assembly.
Figure 7:
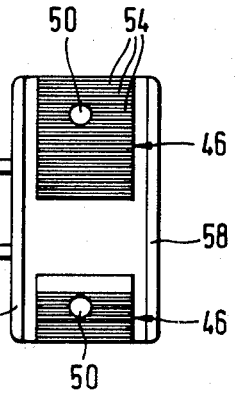
FIG. 7 is a bottom view of the flange plate of the carcass-related part of the hinge, as seen in the direction of the arrow 7 in FIG. 6.
Figure 8:
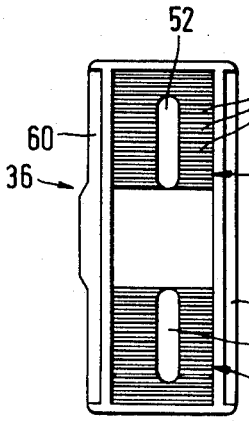
FIG. 8 is a top view of the adjusting plate as seen in the direction of the arrow 8 in FIG. 6.

The hinge shown in FIGS. 1 to 4 and designated in is entirety with the reference numeral 10 serves for pivotally connecting the door leaf 12 to a cabinet the clear or unobstructed door opening of which is narrowed, or made smaller, by a frame 16 which extends at right angles with respect to the walls 14 of the cabinet. The door leaf 12, in the closing position shown in FIGS. 2 and 4, covers the front face 18 of the frame 16 by a predetermined amount, and this amount is adjustable for purposes of aligning the door leaf relative to the frame, within a range a as shown in FIG. 2.

The door-related mounting part, designed as a cup 22 which can be inserted in and connected to a recess 20 in the door leaf 12, and the hinge mechanism comprising two pivotable hinge links 26, 28, respectively connected to the cup 22 and a carcass-related mounting part 24, are of conventional design and, therefore, not described in greater detail here.

Distinct from the customary hinges, however, the carcass-related mounting part 24 which can be connected to the end face 30 of the frame 16, is adapted to the specific application to cabinets with inwardly protruding frame. More specifically, the carcass-related mounting part 24 includes a flange plate 32 which is elongated in the longitudinal direction of the frame end face 30, with two integral and protruding parallel bearing extensions 34 between which the carcass-related ends of the links 26, 28 are pivotally journaled and which, as to form, preferably correspond to the front end of lateral wings of a supporting arm ordinarily used in four-joint hinges. In the embodiment shown in FIGS. 1 to 4, the flange plate, together with the bearing extensions 34 is a one piece, metal die-cast part. However, it is to be understood that the flange plate may be made from a different material and by a different method.

Below the bottom side of flange plate 32 facing the frame end face 30 is arranged an adjusting plate 36 which is likewise elongated in the longitudinal direction of the frame end face and which is longer than the flange plate 32. With the hinge 10 in mounted position, the underside of the adjusting plate 36 rests on the end face 30. The connection of the flange plate 32 and the adjusting plate 36 at frame 16 is effected by two connecting screws 39 which will be described further in connection with the description of FIGS. 5 to 8.

The adjusting plate 36, which in the illustrated example is made of plastic, is provided at that lower longitudinal rim which is associated with the front side 18 of the frame, with a thin protruding abutment strip 38 (FIGS. 1 and 2) which in the proper mounting position of the hinge rests against the front face 18 of the frame which is to be considered the reference surface. Since this abutment strip is, as mentioned above, deliberately very thin it practically adds nothing to the dimensions of the hinge.

The adjusting plate 36 could also be provided, along the longitudinal margin associated with the back side 40 of the frame, with an adjustment strip or ledge corresponding to strip or ledge 38. However, in this instance the space between the inner abutment surfaces of the abutment strips or ledges associated with the frame 16 would have to correspond exactly with the thickness of the frame, i.e. the distance between the front side 18 and the back side 40. The adjustment plates would then only be applicable to a frame of a certain thickness. Since this thickness of the frame, however, varies and the thickness of the wooden frame fluctuates depending on the environment in which it is used, for instance due to drying, the adjustment plate 36 is dimensioned such that it is in any case wider than the largest contemplated thickness of the frame 16. Instead of an abutment strip or ledge an abutment 42 protrudes from the rear of the lower longitudinal margin centrally, which abutment 42 carries two resilient tongues 44 which are bent forwardly and extend parallel to the abutment plate. During placement of the plate 36 onto frame 16, tongues 44 resiliently engage the back side 40 of the frame and thereby pull the adjustment ledge 38 against the front face 18 of the frame. FIG. 4 shows the arrangement and design of extension 42 and the tongues 44 which are integrally connected thereto, and which in this case are made in one piece by injection molding. Due to the resilient deformability of the tongues 44 the adjustment plate 36 is suitable for frames of different thicknesses.

The construction of the flange plate 32 and the abutment plate 36 where they face each other, is clearly shown in FIGS. 5 to 8. It is easily recognizable that at the bottom side of flange plate 32 there are provided two spaced, inclined ramp surfaces 46 which correspond to complementary inclined ramp surfaces 48 on the top side of adjustment plate 36. Upon displacement of adjustment plate 36 relative to flange plate 32 in the longitudinal direction of the end face 30 of the frame, the ramp surfaces 46, 48 slide on each other upwardly or downwardly depending on the direction of displacement so that the distance of the flange plate 32 from the end face 30 of the frame changes. In this way, the displacement of the door leaf 12 indicated by the displacement measure a in FIG. 2 is made possible. In order to displace the adjustment plate 36 in respect to the flange plate 32, of course, they must be loosened sufficiently and subsequently must be fixedly connected with the frame. This is accomplished by the connecting screws 39 already mentioned above. The threaded shafts of the screws penetrate respectively a suitable bore 50 in the flange plate 32 and an oblong hole 52 in the adjustment plate 36 extending in the longitudinal direction of the end face 30. These screws are screwed into the frame 16. The length of the oblong holes 52 predetermines the amount of displacement of the adjustment plate 36 relative to the flange plate 32.

The complementary ramp surfaces of the flange plate 32 and the adjustment plate 36 which face each other are provided with a large number of transverse ribs 54 and 56, respectively, which are equally distributed and extend transverse to the displacement direction of the adjustment plate 36. The ribs guarantee a form-locking connection between the two plates in a selected position, with the connecting screws 39 fastened.

The alignment of the flange plate 32 relative to the adjustment plate 36 transverse to the direction of displacement is assured by ribs 58 and recesses 60, respectively, which extend in the direction of displacement and which inter-engage.

Figure 9:
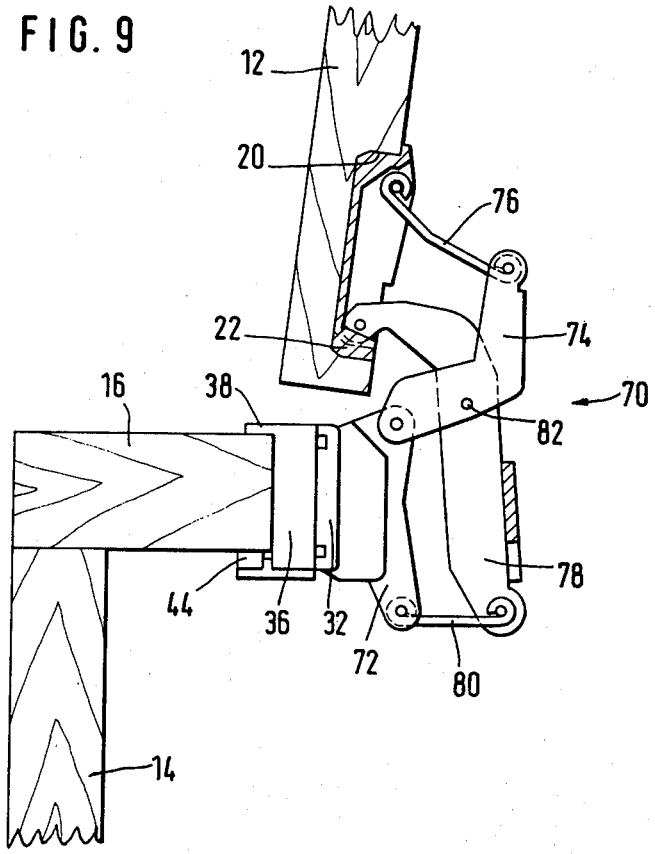
FIG. 9 is a side view, similar to that of FIGS. 1 and 2 of a second embodiment of the present invention, in the form of a cross-link hinge in a position intermediate the totally open and closed position of the hinge.

The hinge 70 illustrated in FIG. 9 differs from the above-described four-joint hinge 10 in that it is constructed as a cross-link hinge which allows for a larger opening angle up to 180 degrees. Instead of the bearing extensions 24 of hinge 10 an elongated extension 72 is provided on the flange plate 32. A cross-link arm 74 is pivotally journaled on the protruding front end of the extension 72 where it faces the door leaf 12 while its other end is connected to the door-related mounting part 22 by means of a link 76 which is pivotally mounted to the cross-link arm 74 as well as to the interior of the door-related mounting part 22.

A second cross-link arm 78 is at its front end pivotally mounted in the interior of the door-related mounting part 22 and at its rear end via a link 80—corresponding to link 76—coupled to the carcass inner end of the bearing extension 72. The two links 74 and 78 are, in addition, directly pivotally interconnected at a point 82 between their ends.

I claim:

1. An articulated hinge for pivotally connecting a door leaf to a carcass of a furniture piece having a carcass wall and a frame protruding at right angles from said carcass wall and having a front face, and a rear face substantially parallel to said front face, said frame having an end face defining an unobstructed door opening of the furniture piece, said end face extending substantially at right angles to said front and rear faces, and having a relatively narrow width between said front and rear faces, and its major longitudinal extension perpendicular to said width, said front face in the closed position of the door leaf being covered at least in part by the door leaf; said hinge having a carcass-related mounting part adapted to be adjustably mounted to the frame, and a door-related mounting part adapted to be mounted at the door leaf and pivotally connected via a link mechanism with said carcass-related mounting part so as to be pivotable about an axis extending parallel to said longitudinal extension when mounted to said frame, said carcass-related mounting part comprising a flange plate for holding said link mechanism and adapted to be detachably connected to the end face, said flange plate having at least one through bore for at least one connecting screw to be screwed into the end face; an adjustment plate on that side of the flange plate which faces the frame end face when mounted thereto, said adjustment plate being displaceable by a predetermined amount relative to the flange plate in the direction of said longitudinal extension, said adjustment plate, in the area below said at least one bore being provided with an oblong hole extending in the direction of displacement of the adjustment plate relative to the flange plate, surfaces of the flange plate and the adjustment plate facing each other being provided with at least one pair of complementary ramp surfaces each extending in the direction of said longitudinal extension and inclined with respect to said pivot axis of said link mechanism, said surfaces upon displacement of the adjustment plate relative to the flange plate sliding on each other, to thereby effect a change in the distance of the flange plate from the frame end face when mounted thereto and thereby a corresponding change of the amount of overlap of the frame by the door leaf.

2. A hinge according to claim 1, wherein the flange plate and the adjustment plate are provided with ribs and recesses, respectively, which extend in the direction of the displacement of the adjustment plate in order to prevent displacement in directions deviating from the direction of displacement.

3. A hinge according to claim 1, wherein the width of the adjustment plate is wider than the end face of the frame to which it is to be mounted as measured transverse to the direction of displacement of the adjustment plate, said adjustment plate having a relatively thin abutment ledge from the bottom side of the adjustment plate for engagement with the front side of the frame adjacent the door leaf.

4. A hinge according to claim 3, wherein the adjustment plate is provided at its longitudinal margin associated with the back side of the frame remote from the door leaf with at least one resilient element projecting from its bottom side and being adapted to be pretensioned transversely of the adjustment plate; said resilient element in the mounted position of the hinge on the frame abutting under pretension the back side of the frame and pulling the abutment ledge against the front face of the frame.

5. A hinge according to claim 4, wherein the resilient element is formed by at least one resilient tongue arranged at an extension of the adjustment plate.

6. A hinge according to claim 1, wherein the complementary ramp surfaces of the flange plate and the adjustment plate are each provided with a plurality of transverse ribs extending transverse to the direction of displacement of the adjustment plate, said ribs being substantially equally spaced from each other.

7. A hinge according to claim 6, wherein the flange plate is provided with at least one bearing extension for holding the link mechanism.

8. A hinge according to claim 7, wherein the flange plate including said at least one bearing extension is an integral metal die-cast piece.

9. A hinge according to claim 7, wherein said adjustment plate is a plastic, injection molded piece.

10. A hinge according to claim 1 including a link mechanism in the form of four-joint link mechanism with two links having ends respectively pivotally connected to said carcass-related mounting part and the door-related mounting part.

11. A hinge according to claim 1 including a link mechanism in the form of a cross-link mechanism to permit pivoting of the door-related mounting part relative to the carcass-related mounting part by an opening angle of up to 180 degrees.

* * * * *